US006527547B2

(12) United States Patent
De Bruin et al.

(10) Patent No.: US 6,527,547 B2
(45) Date of Patent: Mar. 4, 2003

(54) OVEN AND PROCESS FOR MANUFACTURING AN ENVELOPE FOR USE IN A DISPLAY TUBE

(75) Inventors: Harm Jitse De Bruin, Eindhoven (NL); Adrianus Gerardus Goverdina Maria Michielsen, Eindhoven (NL); Johannes Albert Meeske, Eindhoven (NL); Bernhard Jacobus Maria Gerardus Hendriks, Eindhoven (NL); Mathijs Robert De Wilde, Eindhoven (NL); Gerrit Hendrik Siegers, Eindhoven (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 0 days.

(21) Appl. No.: 09/904,075

(22) Filed: Jul. 12, 2001

(65) Prior Publication Data

US 2002/0006594 A1 Jan. 17, 2002

(30) Foreign Application Priority Data

Jul. 13, 2000 (EP) ..... 00202496

(51) Int. Cl.[7] ..... H01J 9/26

(52) U.S. Cl. ..... 432/133; 445/25; 445/26; 445/45; 445/66

(58) Field of Search ..... 432/121, 128, 432/133, 143, 194; 445/25, 26, 40, 45, 66; 219/400; 65/41, 119

(56) References Cited

U.S. PATENT DOCUMENTS

| | | | | |
|---|---|---|---|---|
| 2,861,392 A | | 11/1958 | Vincent | |
| 4,498,884 A | | 2/1985 | Stover et al. | 445/45 |
| 4,752,268 A | | 6/1988 | Kataoka et al. | 219/66 |
| 5,277,640 A | | 1/1994 | Shinmyou et al. | 445/66 |
| 5,681,198 A | * | 10/1997 | Peng et al. | 445/45 |
| 6,015,288 A | * | 1/2000 | Mundon | 445/45 |
| 6,027,390 A | * | 2/2000 | Koizumi et al. | 445/45 |

FOREIGN PATENT DOCUMENTS

| | | |
|---|---|---|
| FR | 2370941 | 6/1978 |

* cited by examiner

*Primary Examiner*—Gregory Wilson

(57) ABSTRACT

The invention relates to an oven for sealing a panel to a funnel, thus forming an envelope suitable for use in a display tube, comprising a tunnel structure 9 and at least one mount for conveying an assembly of a panel and a funnel through the tunnel structure 9. The tunnel structure 9 is provided with a longitudinal slot 16A and the components of the mount for guiding the mount along and through the tunnel structure 9 are placed outside the tunnel structure. It is preferred that the components comprise a means, such as a pump or compressor 24, for flushing the interior of the assembly 22 with a fluid obtained from a source which is substantially separated from the gas(es) circulating in the oven 1, e.g. from the surroundings of the oven 1.

11 Claims, 4 Drawing Sheets

OVEN AND PROCESS FOR MANUFACTURING AN ENVELOPE FOR USE IN A DISPLAY TUBE

The invention relates to an oven for sealing a panel to a funnel, thus forming an envelope suitable for use in a display tube, the oven comprising a tunnel structure, means for heating and circulating gas(es) inside the tunnel structure, and at least one mount for conveying an assembly of a panel and a funnel through the tunnel structure.

The invention also relates to a process for sealing a panel to a funnel, which involves heating and subsequently cooling an assembly of a panel and a funnel at least by means of gas(es) circulating in an oven and flushing the interior of the assembly with a fluid, as well as to the use of an in-line exhaust oven for sealing a panel to a funnel.

A display tube, such as a color cathode-ray tube, usually comprises a bulb or envelope which is composed of a panel or display screen and a funnel or cone which are adhered together. The funnel is accurately positioned in an adhering jig and the edge of the funnel is provided with a glass frit. The panel is placed on top of the funnel and the adhering jig containing the assembly of a panel and a funnel is passed through an oven in which the assembly is heat-treated and the glass frit recrystallizes. Thus, the panel and the funnel are joined rigidly and in a vacuum-tight manner.

Subsequently, an electron gun is placed in the neck of the funnel, and the envelope is evacuated by passing it once again through an oven in which the display tube is degassed at a fixed temperature. During the cooling process, the envelope, which is now usually referred to as display tube, is sealed in a vacuum-tight manner.

An example of a conventional process for forming envelopes suitable for use in display tubes is disclosed in e.g. U.S. Pat. No. 5,277,640. This publication describes a frit seal furnace (1), comprising a furnace body (3) having heating means (2) such as tube burners, and conveyor belts (5) movable in the furnace body (3) (The numbers between parentheses in this and the next paragraph relate to the numbers in the Figures of U.S. Pat. No. 5,277,640.). The furnace body (3) is lined with a heat insulation (6), and the heating means are disposed in aligned positions on opposite sides of the conveyor belts. Fans (7) are disposed above the conveyor belts (5) for directing air downwardly in the furnace. The heating means are divided into zones (8) arranged along the direction in which the belts move. Each conveyor belts comprises a pair of chain belts (4) and can be driven in a circulating fashion, over and below a furnace floor (3a). In comparison with a mesh belt, said chain generates fewer metal particles.

A panel (31) and a funnel (32) are superposed one on the other with a frit glass (33) interposed therebetween in a mount (21). This mount comprises a base (22) in the form of a frame, a holder (24) connected to the base by a plurality of legs (23) for engaging a round portion of the funnel, and abutments (25) for abutting against three sides, respectively, of the panel and the funnel.

The mount also has a mesh screen as a floor surface, i.e. a surface where the mount is placed on one of the conveyor belts in the frit seal furnace.

U.S. Pat. No. 5,277,640 further mentions that, since air is caused to flow downwardly in the furnace by the fans, any metal particles are prevented from being attached to (the outer surface of) the frit glass, and that it is possible to insert an air nozzle into the assembly from below in the frit seal furnace. Thus, clean air may be supplied from an external source through the air nozzle into the assembly. However, insertion of the nozzle into the assembly is very difficult or even impossible in practice due the presence of the aforementioned conveyor chains, the legs, and the mesh screen.

A disadvantage of this oven and process is that a substantial number of sealed envelopes still do not fulfil the specifications for a commercial television set. In particular, one or more pixels of the panel may be rendered inoperative by the presence of metal particles.

It is an object of the present invention to further reduce the number of metal particles generated by the means with which the assemblies of a panel and a funnel are transported through the tunnel structure. It is a further object of the present invention to facilitate the supply of a fluid to the interior of the assembly and hence allow more controlled and effective flushing.

To this end, the oven as described in the opening paragraph is characterized in that the tunnel structure is provided with a longitudinal slot and in that the mount comprises first components for carrying an assembly of a panel and a funnel, which first components, at least during sealing of the panel to the funnel, are placed inside the tunnel structure, and second components for guiding the first components through the tunnel structure, which second components are placed outside the tunnel structure and support the first components, via the longitudinal slot.

It appeared that many defects in the panel or frit seal originate from pollution of the interior of the envelope by dust particles, such as metal particles and small fragments of glass, from the oven. By means of the invention, the greater part of the wear and hence of the number of metal particles generated is located outside the tunnel structure and contamination is effectively reduced. Further, fluid communication between the interior of the assembly and a fluid source, such as filtered clean air, outside the oven can be established through the longitudinal slot.

Accordingly, it is preferred that said second components comprise a means for flushing the interior of the assembly with a fluid that is obtained from a source that is substantially separated from the gas(es) circulating in the oven. It is further preferred that said means for flushing the interior of the assembly comprises at least one pump or compressor, which is in fluid communication with the interior of the assembly. In a very practical embodiment, the factory hall itself serves as a source of the flushing fluid, especially when the air in the factory is filtered and/or conditioned. It that case care should of course be taken that the inlet of the means for flushing the interior of the assembly is not too close to the factory floor or, e.g., wheels or a guiding rail, unless a filter of some sort is provided downstream of the inlet.

The present invention further relates to a process as described in the opening paragraph, which preferably employs an oven as described above, wherein the fluid, which primarily serves for flushing the interior and removing gases, in particular NOx, generated by the frit and by the electrically conductive layer of the funnel, is also employed to control the temperature of the assembly during heating and/or cooling. Thus, the temperature treatment of the assembly can be carried out more homogeneously and/or heating and/or cooling can e.g. be accelerated as a result of which relaxation of built-in pre-tensions, which are, inter alia, used to reduce the risk of a cracked envelope, is suppressed. The presence of oxygen in the fluid will prevent or at least suppress the chemical reduction of metal oxides, such as PbO, which is usually a major component of the glass frit, or $Fe_3O_4$, which is frequently used in a composition for forming an electrically conductive layer inside the envelope. The use of a fluid as described above is not limited to use in an oven according to the invention. The process may be used in any situation wherein the interior of an envelope is flushed.

The invention can be implemented by using an in-line exhaust oven for sealing a panel to a funnel, which oven comprises at least one mount for conveying an assembly of a panel and a funnel through the tunnel structure, wherein the mount comprises first components for carrying an assembly of a panel and a funnel, which first components, at least during the sealing of the panel to the funnel, are placed inside the tunnel structure, and second components for guiding the mount along and through the tunnel structure, which second components are placed outside the tunnel structure and comprise a means for flushing the interior of the assembly with a fluid. An oven suitable for such use is, for instance, described in U.S. Pat. No. 4,498,884 (see FIG. 4 and the accompanying description in that application).

It is preferred that the second components comprise a means for flushing the interior of the assembly with a fluid obtained from a source which is substantially separated from the gas(es) circulating in the oven.

The present invention will now be further explained with reference to the drawings, in which an embodiment of the oven and details of some of its components are schematically shown.

Figure 1:
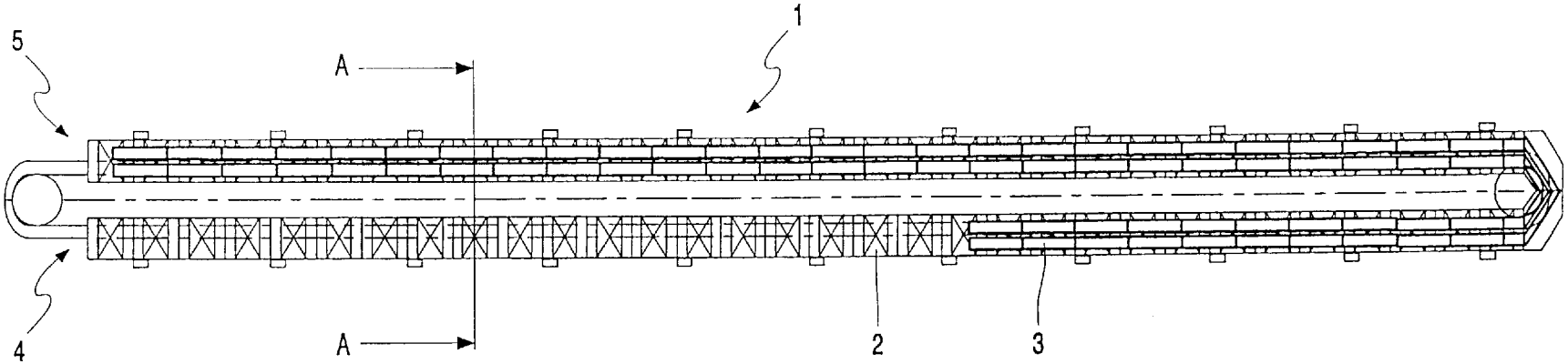
FIG. 1 is a top view of an in-line fritting oven in accordance with the present invention.

FIG. 1 shows an in-line frit oven 1 comprising a number of heating segments 2 and a number of cooling segments 3 which are arranged in a U-shape with an entrance 4 and an exit 5 placed in each other's proximity so as to avoid pressure differences over said entrance 4 and the exit 5. Pressure differences are generally responsible for driving heated air out of the oven and cool air into the oven and hence result in loss of energy.

Figure 2:
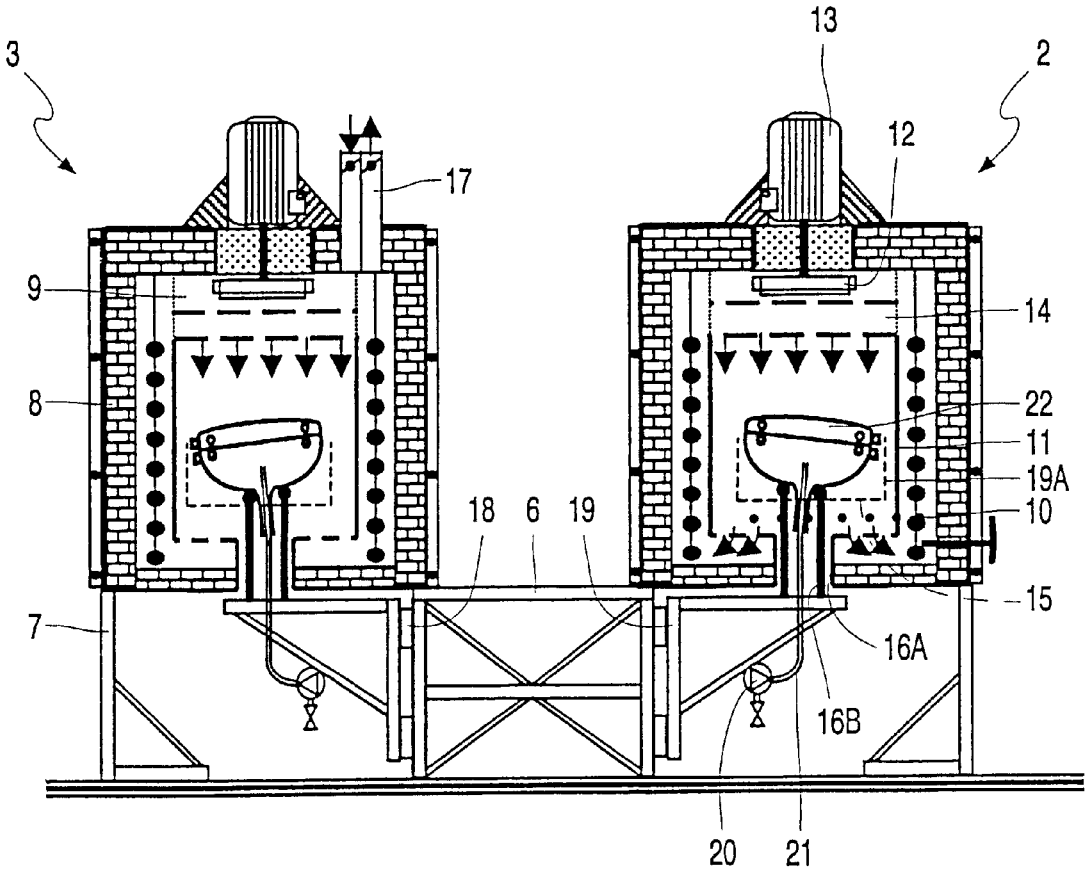
FIG. 2 is a schematical cross-section taken on the line A—A in FIG. 1.

As can be seen in FIG. 2, the segments 2, 3 are supported by a central frame 6 and by legs 7. The segments 2, 3 comprise insulating and refractory walls 8, which form a tunnel structure 9. The air inside the tunnel structure 9 is heated by heaters 10, which are placed on either side of an internal metal duct 11 having a rectangular cross-section, i.e. in the narrow spaces defined by the outer surface of the side walls of the duct 11 and the inner surface of the insulating side walls 8. The air is circulated by means of convection and a fan 12, which is driven by an electric motor 13 placed on top of its respective segment 2, 3. The fan 12 forces air into a pressure box 14 which comprises upper and lower perforated plates and distributes the air into an even down flow inside the duct 11.

The duct 11 comprises, in its bottom side, openings 15 through which the air leaves the duct 11 to be re-circulated over the heaters 10. Temperature control means (not shown) control the energy output of the heaters 10. Since the conditions in each of the segments 2, 3 can be accurately controlled, the temperature treatment can also be accurately controlled.

The bottom wall of the segments 2, 3 is provided with a longitudinal slot 16A which runs the length of the entire oven 1. The duct 11 also comprises a longitudinal slot 16B which has substantially the same width and generally registers with the longitudinal slot 16A in the bottom wall.

The cooling segment 3 (shown on the left-had side of FIG. 2) is essentially similar to the heating segment 2 (on the right-hand side of FIG. 2) apart from the fact that this particular segment 3 comprises a servo-controlled cooling system 17 for supplying (relatively) low temperature air to the tunnel structure 9.

The central frame 6 comprises guide rails 18 which support the lower components of at least one mount, in this case comprising a carrier 19 and an adhering jig 19A. The carrier 19 is equipped with a pump or compressor 20, which communicates, by means of a pipe 21, with the interior of an assembly 22 of a panel and a funnel which is placed in the adhering jig 19A. The pipe 21 extends through the longitudinal slot 16A in the bottom wall of the segments 2, 3 and into said interior of the assembly 22.

Figure 3:
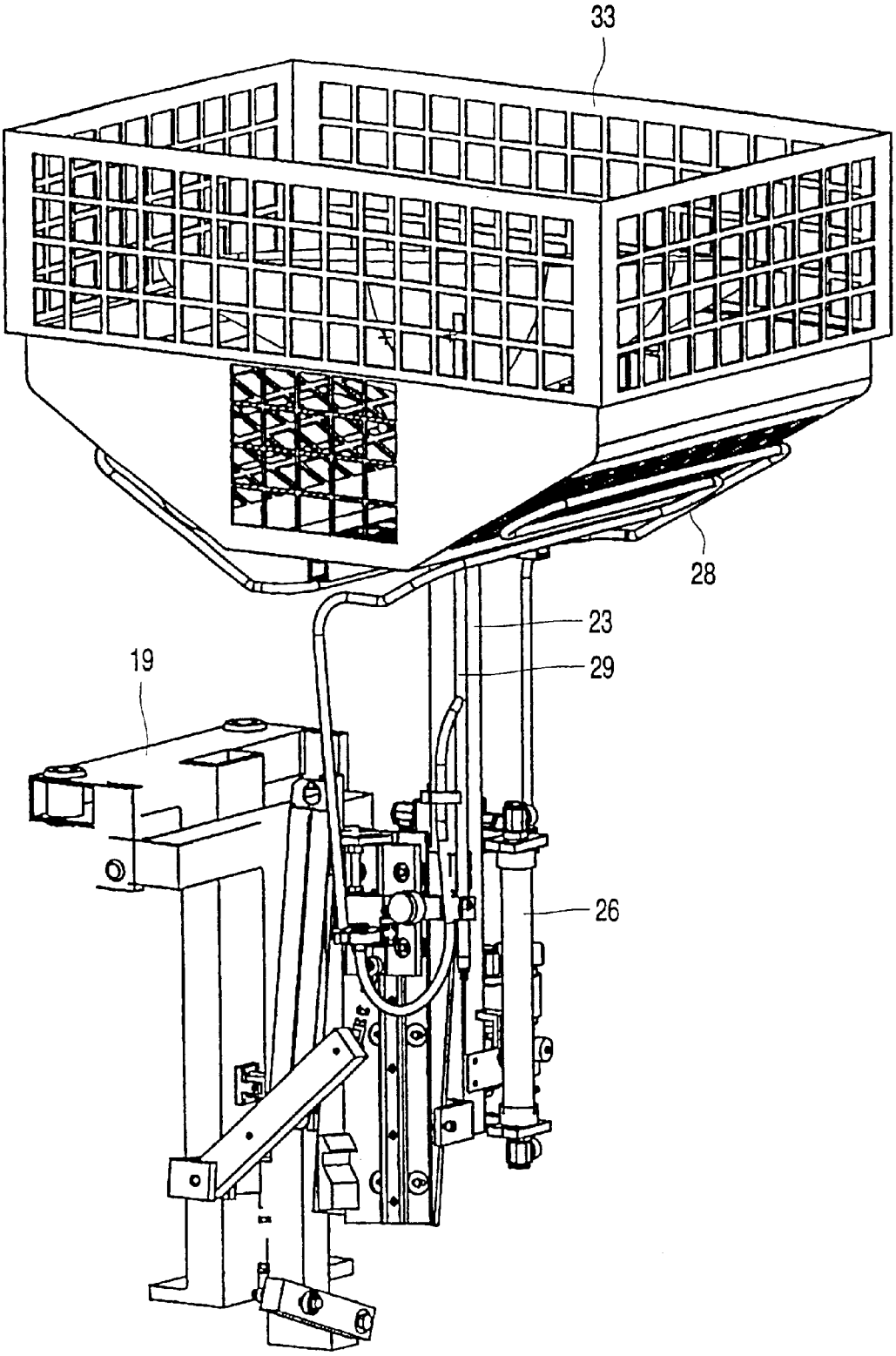
FIG. 3 is a schematical perspective view of a mount suitable for use in the oven of FIG. 1.
Figure 4:
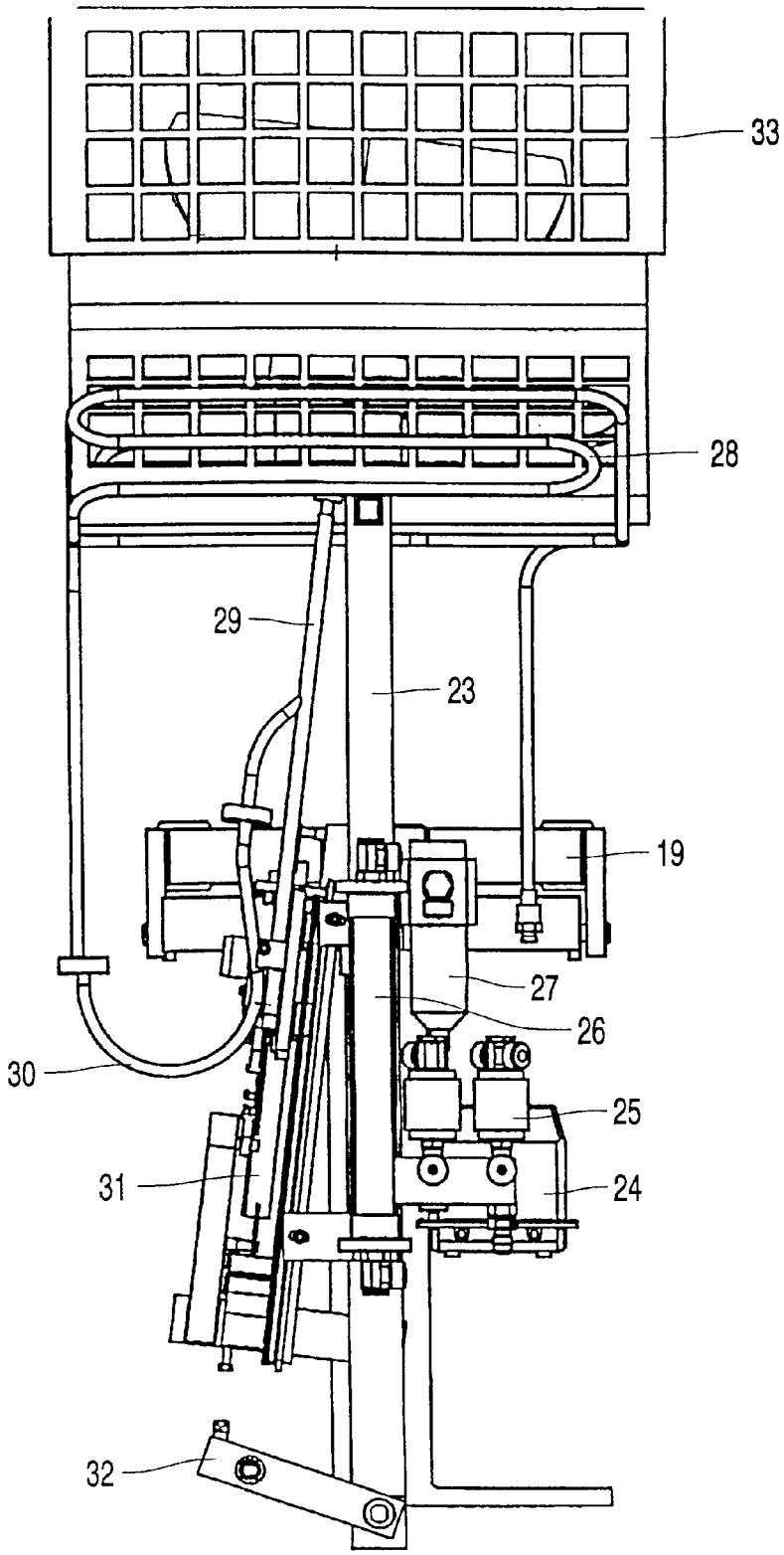
FIG. 4 is a side view of the mount of FIG. 3.

FIGS. 3 and 4 show a suitable and more specific example of the mount, which mount comprises a carrier 19 to which a central and substantially vertical support beam 23 has been attached. The support beam 23 will extend through the longitudinal slot, at least during the sealing of the panel to the funnel. The support beam 23 carries a compressor 24, at least one valve 25, a flow rate meter 26, a filter 27, a heat exchanger 28 and a rigid chimney 29. If two or more sources of a flushing fluid (usually a gas) are available, such as, in this particular example, a compressor 24 for supplying air from the surroundings and e.g. a nitrogen source (not shown), the valve(s) 25 can be used to control the flow rate, select a specific source and optionally switch over to another source during the sealing process. The selected fluid is directed through the flow rate meter 26, through the filter 27 for further purifying the fluid and into heat exchanger 28, which essentially consists of a metal pipe having and inner and outer diameter and a length which, in this particular and preferred example, are selected to heat the fluid to a temperature substantially equal to or just a few degrees (° C.) below the temperature of the gas(es) circulating around the heat exchanger 28. Thus, during the sealing process, the temperature of the flushing fluid will be substantially equal to the temperature of the gas(es) in the tunnel structure, which results in a homogeneous heat treatment and/or can be used to accelerate the heat treatment. It is of course also possible e.g. to use a separate heater to control the temperature of flushing fluid.

Upon leaving the heat exchanger 28, the fluid is directed to the chimney 29 by means of a flexible metal pipe, preferably a stainless steel bellow pipe 30. Said chimney 29 extends through the neck of the aforementioned assembly 22 into its interior.

The chimney 29 is connected to a support 31, which is slidably connected to the support beam 23. The support 31 and hence the chimney 29 can be moved up and down by means of a lever mechanism comprising a lever 32. The lever 32 may, for instance, be forced downwards upon exiting the oven by means of a roller or can be attached to the lower part of the central frame of the oven. By retracting the chimney 29, the risk of damaging the neck of the funnel during loading and removal of the envelope from the adhering jig is reduced considerably.

The support beam 23 further carries an adhering jig, which is provided with abutments for fixing the position of the assembly 22 and a safety cage 33.

With this type of mount, a conveyor belt is no longer required and, as a consequence, wear and the generation of metal particles takes place mostly outside the tunnel structure. Further, the supply of flushing fluid can be controlled more easily e.g. in terms of flow rate, composition, and/or temperature.

The invention is not in any way limited to the embodiment described above, which can be varied in several ways within the scope of the claims.

What is claimed is:

1. An oven for sealing a panel to a funnel, thus forming an envelope suitable for use in a display tube, the oven comprising a tunnel structure, means for heating and circulating gas(es) inside the tunnel structure, and at least one mount for conveying an assembly of a panel and a funnel through the tunnel structure, characterized in that the tunnel structure (9) is provided with a longitudinal slot (16A) and the mount comprises first components for carrying an assembly of a panel and a funnel, which first components, at least during sealing of the panel to the funnel, are placed inside the tunnel structure (9), and second components for guiding the first components through the tunnel structure, which second components are placed outside the tunnel structure and support the first components, via the longitudinal slot (16*a*), wherein said second components comprise a means for flushing the interior of the assembly (22) with a fluid obtained from a source which is substantially separated from the gas(es) circulating in the oven (1).

2. An oven as claimed in claim 1, wherein said means for flushing the interior of the assembly (22) comprises at least one pump or compressor (24), which can be brought into fluid communication with the interior of the assembly (22).

3. An oven as claimed in claim 2, wherein the pump or compressor is in fluid communication (24) with the interior of the assembly (22) through a duct which comprises a rigid chimney (29) at or near its end for insertion into the interior of the assembly (22).

4. An oven as claimed in claim 3, wherein the chimney (29) is retractable.

5. An oven as claimed in claim 1, wherein the oven (1) is arranged to accommodate a single row of a plurality of mounts.

6. An oven as claimed in claim 1, wherein the longitudinal slot (16A) is located in or near the bottom side of the tunnel structure (9).

7. An oven for sealing a panel to a funnel, thus forming an envelope suitable for use in a display tube, the oven comprising a tunnel structure, means for heating and circulating gas(es) inside the tunnel structure, and at least one mount for conveying an assembly of a panel and a funnel through the tunnel structure, characterized in that the tunnel structure (9) is provided with a longitudinal slot (16A) and the mount comprises first components for carrying an assembly of a panel and a funnel, which first components, at least during sealing of the panel to the funnel, are placed inside the tunnel structure (9), and second components for guiding the first components through the tunnel structure, which second components are placed outside the tunnel structure and support the first components, via the longitudinal slot (16*a*), wherein said first components are provided with a heat exchanger (28) for heating the fluid by means of the gas(es) circulating in the oven (1) prior to entering the interior of the assembly (22).

8. A process for sealing a panel to a funnel by means of an oven, thus forming an envelope suitable for use in a display tube, which process comprises the steps of heating and subsequently cooling an assembly of a panel and a funnel at least by means of gas(es) circulating in an oven and flushing the interior of the assembly with a fluid, characterized in that the fluid is employed to control the temperature of the assembly during heating and/or cooling, the oven comprising:

a tunnel structure, means for heating and circulating gas(es) inside the tunnel structure, and at least one mount for conveying an assembly of a panel and a funnel through the tunnel structure, characterized in that the tunnel structure (9) is provided with a longitudinal slot (16A) and the mount comprises first components for carrying an assembly of a panel and a funnel, which first components, at least during sealing of the panel to the funnel, are placed inside the tunnel structure (9), and second components for guiding the first components through the tunnel structure, which second components are placed outside the tunnel structure and support the first components, via the longitudinal slot (16*a*).

9. A process for sealing a panel to a funnel as claimed in claim 8, wherein the fluid contains oxygen.

10. Use of an in-line exhaust oven for sealing a panel to a funnel, thus forming an envelope suitable for use in a display tube, which oven comprises at least one mount for conveying an assembly of a panel and a funnel through the tunnel structure (9), wherein the mount comprises first components for carrying an assembly of a panel and a funnel, which first components, at least during sealing of the panel to the funnel, are placed inside the tunnel structure, and second components for guiding the mount along and through the tunnel structure, which second components are placed outside the tunnel structure and comprise a means for flushing the interior of the assembly (22) with a fluid.

11. Use of an in-line exhaust oven as claimed in claim 10, wherein said second components comprise a means for flushing the interior of the assembly (22) with a fluid obtained from a source which is substantially separated from the gas(es) circulating in the oven (1).

* * * * *